US005342136A

United States Patent [19]

Fukami

[11] Patent Number: 5,342,136

[45] Date of Patent: Aug. 30, 1994

[54] WRITING INSTRUMENT WITH EXCHANGEABLE INK REFILL

[75] Inventor: Masaaki Fukami, Hachioji, Japan

[73] Assignee: Kabushiki Kaisha Allco, Tokyo, Japan

[21] Appl. No.: 63,207

[22] Filed: May 17, 1993

[30] Foreign Application Priority Data

May 22, 1992 [JP] Japan ..... 4-034211[U]
Nov. 13, 1992 [JP] Japan ..... 4-078246[U]

[51] Int. Cl.[5] ..... B43K 8/02; B43K 8/06

[52] U.S. Cl. ..... 401/135; 401/134; 401/198; 401/199

[58] Field of Search ..... 401/132, 133, 134, 135, 401/199, 198

[56] References Cited

U.S. PATENT DOCUMENTS

| | | | |
|---|---|---|---|
| T926,011 | 9/1974 | Kun et al. | 401/199 X |
| 2,026,657 | 1/1936 | Sherman | 120/42 |
| 3,048,879 | 8/1962 | Rosenthal | 401/199 |
| 3,353,899 | 11/1967 | Hechtle | 401/198 |
| 3,399,020 | 8/1968 | Margolis et al. | 401/135 |
| 4,669,906 | 6/1987 | Narushima et al. | 401/135 X |
| 4,844,251 | 7/1989 | Gueret | 401/134 X |

FOREIGN PATENT DOCUMENTS

| | | | |
|---|---|---|---|
| 1250302 | 9/1967 | Fed. Rep. of Germany | 401/199 |
| 2538427 | 3/1977 | Fed. Rep. of Germany | 401/135 |
| 1047934 | 12/1953 | France . | |
| 1565402 | 3/1969 | France | 401/199 |
| 2528767 | 12/1983 | France . | |
| 40199 | 9/1986 | Japan | 401/199 |
| 232098 | 9/1989 | Japan | 401/199 |
| 2001285 | 1/1979 | United Kingdom . | |
| 2194138 | 3/1988 | United Kingdom . | |
| 8201685 | 5/1982 | World Int. Prop. O. . | |

*Primary Examiner*—Steven A. Bratlie
*Attorney, Agent, or Firm*—Ladas & Parry

[57] ABSTRACT

A longer lifetime of a writing instrument having a fibrous writing tip is attained by replacement of a refill, which comprises a body and a wadding impregnated with an ink. The body has closed front and rear ends. The front end may be sealed with a thin sealing film. The body of the writing instrument comprises a pen barrel 1 having a hollow therein, and a writing tip having at its rear end a pointed member protruding therefrom. The refill is fitted into the hollow with the open end whose sealing sheet has been peeled off ahead or with the front end ahead, and is slid to a position where a second stopper abuts against the rear end of the pen barrel. At that time, the rear end of the writing tip is caused to enter the interior of the refill through its open end free from the sealing sheet. Alternatively, the front end of the refill is pierced by a pointed member to cause the rear end of the writing tip to plunge into the wadding. As a result, the ink existing within the wadding is led to the writing tip to effect a writing by the use of this writing instrument.

5 Claims, 5 Drawing Sheets

FIG. 5
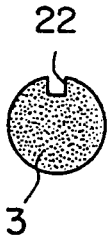
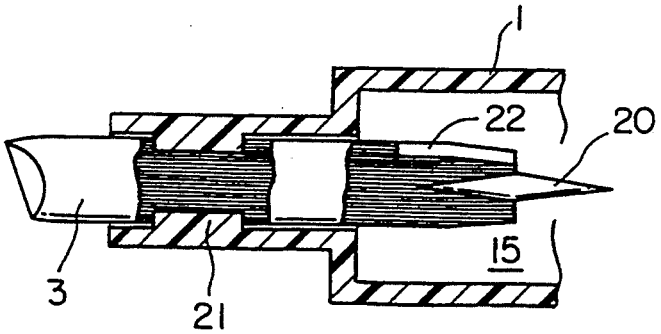
FIG. 6

WRITING INSTRUMENT WITH EXCHANGEABLE INK REFILL

BACKGROUND OF THE INVENTION

1. Field of the Invention

The present invention relates to an ink storing type writing instrument using a refill, and more particularly, to a writing instrument of the above type having a fibrous writing tip such as, for example, a felt tip.

2. Description of the Related Art

In the field of writing instruments, there is a recent trend toward frequent use of an ink storing type pen having a writing tip made of a fibrous material such as, for example, felt, synthetic fibers or animal fur. The body of such writing instrument comprises a pen barrel made of a synthetic resin accommodating therein a wadding which is impregnated with ink, and a writing tip 3 firmly fitted in and secured to a through-hole provided in the front end of the pen barrel, the rear end of the writing tip being immersed in the wadding. The pen barrel has at its rear end a tail plug fitted therein for preventing leakage of the ink, and at its front end a removable cap for covering the writing tip. Such type of writing instrument enables a writing with a relatively wide writing width due to uniform permeation of the ink from the wadding to capillary gaps defined within the writing tip.

The writing instrument having a fibrous writing tip consumes a larger amount of ink due to a relatively wide writing width as described above. As a consequence, its writing distance is significantly shorter than that of the writing instruments having a metallic writing tip or ball-point writing tip. For drawing a 5 mm-wide straight line, for example, a normal size writing instrument of this type presents a writing distance of approximately 100 m to 140 m at most. Nevertheless, the pen barrel and the writing tip must be designed to satisfactorily withstand a writing distance more than 1000 m, in order to meet a required level of mechanical strength. Accordingly, the disposal of an entire writing instrument only for the reason of consumption of ink is a waste of materials from a viewpoint of effective utilization of resources.

SUMMARY OF THE INVENTION

It is therefore the object of the present invention to eliminate the above problem involved in the conventional prior art techniques described above and to provide a writing instrument of the type having a fibrous writing tip, which is capable of being easily replenished with ink by means of a refill to attain an increased lifetime of the writing instrument.

In order to accomplish the above object, the present invention provides an ink storing type writing instrument including a pen barrel having a hollow therein and including a fibrous writing tip fixedly attached to a front end of the pen barrel, comprising: a substantially cylindrical refill having closed front and rear ends and containing a wadding impregnated with an ink, the refill being replaceably fitted in the hollow of the pen barrel through the rear end thereof with its front end receiving therein a rear end of the writing tip, and the front end of the refill being comprised of an openable thin film.

In the present invention, when the ink is used up, a new refill is fitted into the hollow defined within the pen barrel after removal of a used refill, to thereby cause the rear end of the writing tip to enter the interior of the new refill for plunging into the wadding. Thus, the ink is led to the writing tip to enable the writing by the instrument.

BRIEF DESCRIPTION OF THE DRAWINGS

FIG. 5 is a cross-sectional view of a writing tip; and

FIG. 6 is an enlarged sectional view showing a front end portion of the body of the writing instrument.

DESCRIPTION OF THE PREFERRED EMBODIMENTS

Preferred embodiments of an ink storing type writing instrument in accordance with the present invention will now be described with reference to the accompanying drawings.

Figure 1:
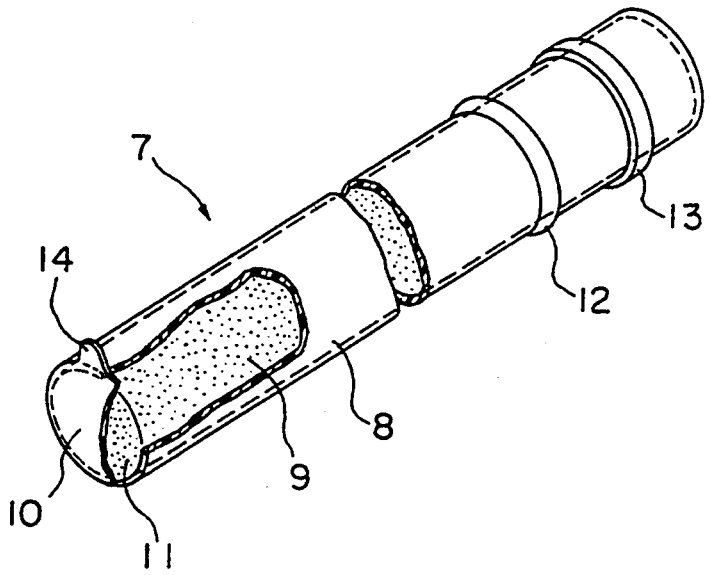
FIG. 1 is a partially cut away, perspective view of a refill for use in the present invention.

Referring first to FIG. 1, there is shown an ink reservoir or refill (hereinafter referred to simply as a refill) generally designated at 7, for use in the present invention. The refill 7 comprises a body 8 and an internal wadding 9. The body 8 is, for example, a substantially cylindrical injection molding of a synthetic resin which includes an opening 11 formed at its front end and annular first and second stoppers 12 and 13 which protrude on the outer surface of the body 8. The first stopper 12 is semicircular in cross section, and the second stopper 13 is rectangular in cross section. The wadding 9 in the body 8 is impregnated with an ink in a manner similar to that in the conventional writing instrument described earlier. The front opening 11 is closed by a sealing sheet 10 made of a thin film. The sealing sheet 10 is fashioned into a circle with its outer periphery partially having a lip 14. The sealing sheet may be made of a laminated film of aluminum and a synthetic resin, and can be attached to the front end of the body 8 by means of, for example, welding or adhesive bonding.

Figure 2:
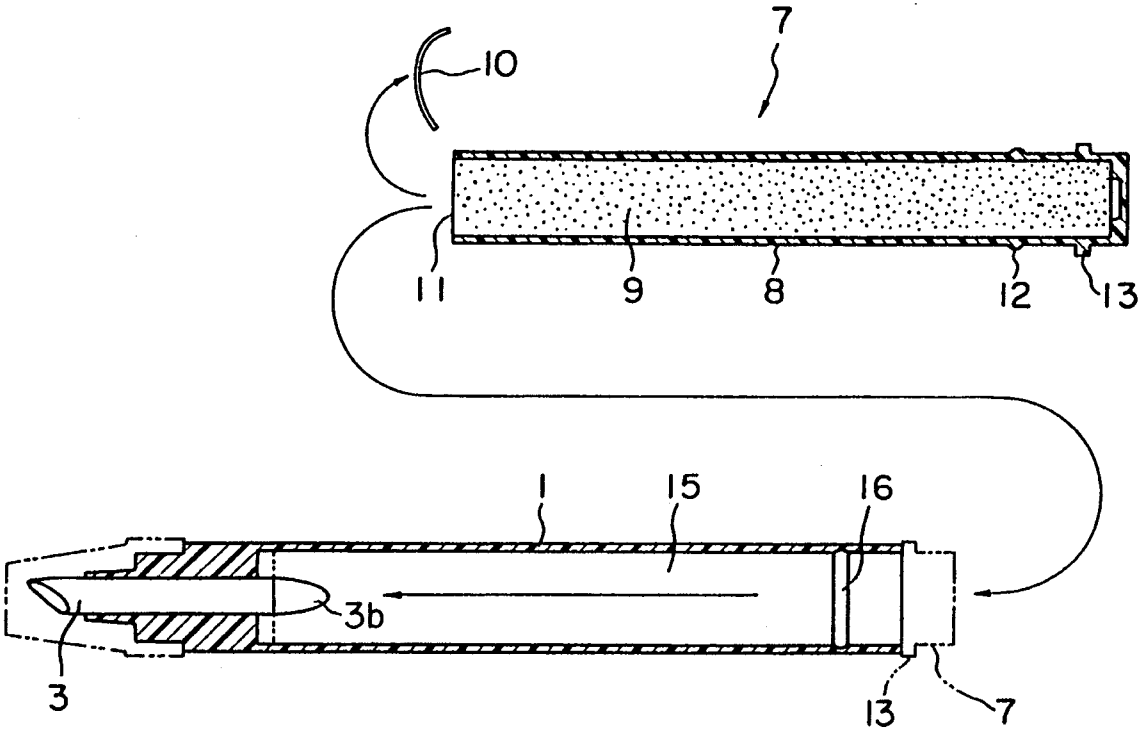
FIG. 2 is an exploded view, in longitudinal section, showing the refill shown in FIG. 1 and a body of the writing instrument.

For the use of the refill 7 in this embodiment, the sealing sheet 10 is first peeled from the front end of the body 8 as shown in FIG. 2 by grasping the lip 14. It will be appreciated that this sealing sheet 10 serves to prevent the evaporation of ink during the storage as well as a possible slip-out of the wadding 9 from within the refill 7. After the completion of peeling the sealing sheet 10, the refill 7 is forced into a hollow 15 defined within a pen barrel 1 of the writing instrument with the opening 11 ahead, and is so positioned that the second stopper 13 is brought into contact with the rear end of the pen barrel 1 as indicated by a chain double-dashed line. The pen barrel 1 has in the vicinity of its rear end an annular groove 16 circumferentially extending along the inner surface defining the hollow 15. The annular groove 16 is adapted to receive the first stopper 12 when the second stopper 13 abuts against the rear end of the pen barrel 1, thereby establishing a secure engagement of the refill 7 with the barrel 1. At the same time, the rear end **3*b* of a writing tip 3 protruding rearward into the hollow 15** is caused to plunge into the wadding 9 to lead the ink existing within the wadding into the writing tip 3, thus enabling a writing by use of this instrument. After the consumption of the ink impregnated in the wadding 9 as a result of writing, the used refill 7 is removed rearwardly and replaced with a new one in the same procedure as described above. Thus, the use of this writing instrument can be made until its pen barrel 1 or writing tip 3 is damaged.

The present invention is not intended to be limited to the above embodiment. Although the body of the refill is shaped into a circular cylinder in the above embodiment, it may be formed into a square or rectangular cylinder. Further, the refill may be screwed to the pen barrel instead of making use of the engagement of the stoppers and groove.

Another embodiment of the present invention will next be described with reference to FIGS. 3 through 6.

Figure 3:
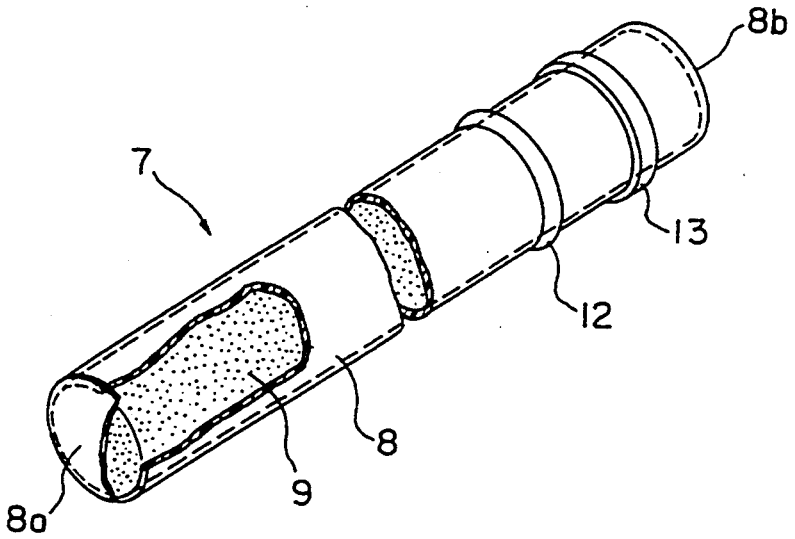
FIG. 3 is a perspective view, partly cut away, showing another example of the refill for use in the present invention.

In this embodiment, as apparent from FIG. 3, a refill 7 comprises a substantially cylindrical body 8 which is injection molded from a synthetic resin, and a wadding 9 being impregnated with ink and adapted to be received in the body 8. The body 8 includes front and rear ends 8*a* and 8*b* each being closed, and annular first and second stoppers 12 and 13 protruding on the body 8. The front end 8*a* is comprised of a laminated thin film of aluminum and a synthetic resin attached to the front end of the body 8 by welding or adhesive bonding. The thin film front end 8 is designed to be ruptured by forcible sticking as described later.

Figure 4:
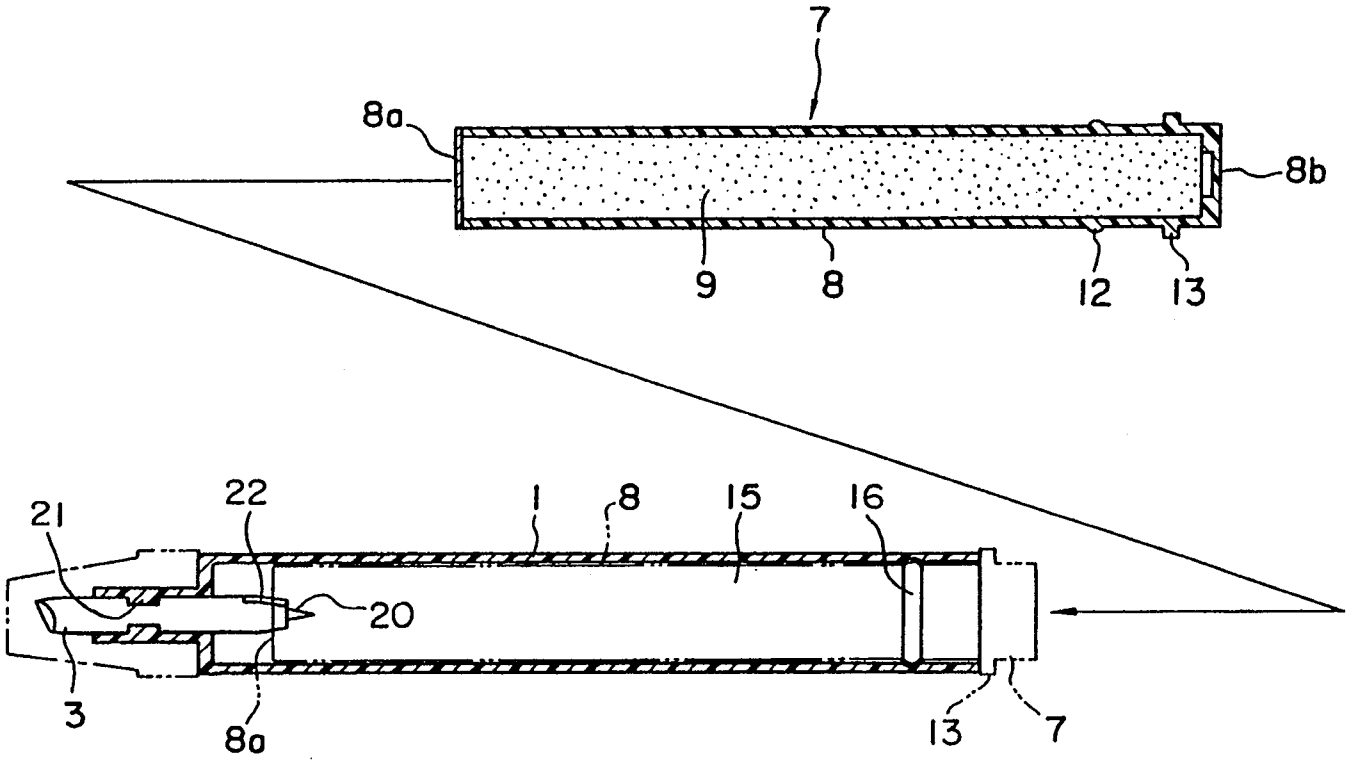
FIG. 4 is an exploded view, in longitudinal section, showing the refill of FIG. 3 and a body of the writing instrument for use in the present invention.

As shown in FIG. 4, the body of the writing instrument comprises a pen barrel 1 including a hollow 15 therein and having in the vicinity of its rear end an annular groove 16 extending along the inner surface of the pen barrel 1 defining the hollow 15. As also shown on an enlarged scale in FIG. 6, the barrel 1 fixedly receives at its front end a writing tip 3 projecting rearward into the hollow 15. The writing tip 3 has at its rear end a hardened pointed member 20 fixedly secured thereto by, for example, press fitting. The pointed member 20 is preferably made of, for example, a polyacetal resin. The tip 3 is firmly engaged with a shoulder 21 to prevent a forward displacement of the tip 3 due to a forward force which is exerted on the tip 3 as described hereinbelow. As also shown in cross section in FIG. 5, the writing tip 3 includes in a portion toward its rear end a longitudinally extending vent groove 22 for the ventilation.

On the other hand, the refill 7 is configured to be loaded into the interior of the pen barrel 1 through an opening formed at the rear end of the pen barrel 1 of the writing instrument body.

In this embodiment, the used refill is discarded through the rear end of the pen barrel 1, and then a new one is fitted into the hollow 15 of the barrel 1 through the rear end of the writing instrument to a position where the second stopper 13 comes into contact with the rear end of the pen barrel 1 as indicated by a chain double-dashed line in FIG. 4. Due to the provision of the annular groove 16 circumferentially extending in the region of the rear end of the pen barrel 1 along its inner surface defining the hollow 15, the first stopper 12 is caused to be fitted into the groove 16 to thereby lock the refill 7 with the body of the writing instrument when the second stopper 13 abuts against the rear end of the pen barrel 1. Simultaneously, the pointed member 20 located at the rear end of the writing tip 3 ruptures the thin film 8*a* resting at the front end of the refill 7 and plunges into the wadding 9. Thus, the ink existing within the wadding 9 is led into the writing tip 3, making it possible to carry out a writing by the use of this instrument. During the writing, the pressures outside and inside the pen barrel 1 are well balanced with each other by virtue of the vent groove 22. After the consumption of the ink impregnated in the wadding 9, the used refill 7 can be repeatedly replaced with a new one in the same manner as described earlier, to thereby permit the writing instrument to be used until the pen barrel 1 or the writing tip is damaged. This embodiment will facilitate the replacement of the refill as compared with the preceding embodiment.

As is clear from the above description, it is possible in the present invention to successively use the writing instrument by the repeated replacement of the refill as long as the pen barrel or the writing tip is not damaged. Advantageously, this results in an effective utilization of material resources due to a reduced quantity of waste.

What is claimed is:

1. An ink storing type writing instrument comprising:

a pen barrel having front and rear ends and a hollow with a cylindrical internal wall;

a rigid felt writing tip fixedly attached to the front end of the pen barrel and having a rear end protruding axially into said hollow, said rear end of the tip having on an outer surface thereof a vent groove extending axially of the tip;

a hard pointed member securely inserted axially into said rear end of the writing tip and having a rear pointed end projecting rearwardly;

a cylindrical refill having a closed front end formed of a thin film and a closed rear end and containing a wadding impregnated with ink, said refill having stopper means and being replaceably fitted in said hollow of the pen barrel through the rear end of the writing tip; and said stopper means being in abutting relation with the pen barrel to place the refill in a predetermined axial position where said pointed member pierces said thin film of the refill and is positioned entirely within the refill and where said rear end of the writing tip is partly located in said refill for receiving ink supply from within the refill and for causing the vent groove to be disposed partly within the refill for venting operation.

2. An ink storing type writing instrument according to claim 1, wherein said pointed member is press fitted into the writing tip.

3. An ink storing type writing instrument according to claim 1, wherein said pointed member is made of a synthetic resin.

4. An ink storing type writing instrument according to claim 1, wherein said thin film is made of a laminated film of aluminum and a synthetic resin.

5. An ink storing type writing instrument according to claim 1, wherein said stopper means is an annular protrusion.

* * * * *